United States Patent [19]

Oooka et al.

[11] 4,247,927

[45] Jan. 27, 1981

[54] DIGITAL ELECTRONIC TIMEPIECE

[75] Inventors: Mituo Oooka; Makoto Yoshida, both of Tokorozawa; Masamichi Yamauchi, Ichikawa; Choken Suzuki, Tokyo, all of Japan

[73] Assignee: Citizen Watch Company Limited, Tokyo, Japan

[21] Appl. No.: 1,251

[22] Filed: Jan. 5, 1979

Related U.S. Application Data

[63] Continuation of Ser. No. 784,742, Apr. 5, 1977, abandoned.

[30] Foreign Application Priority Data

| | | | |
|---|---|---|---|
| Apr. 7, 1976 | [JP] | Japan | 51-39007 |
| Apr. 7, 1976 | [JP] | Japan | 51-39008 |
| Dec. 27, 1976 | [JP] | Japan | 51-157789 |

[51] Int. Cl.[3] ..... G04G 9/06; G04G 9/12

[52] U.S. Cl. ..... 368/30; 368/62; 368/69; 368/111

[58] Field of Search ..... 58/4 A, 23 R, 21.13, 58/39.5, 38, 57.5, 50 R, 58, 152 R; 328/129; 325/92 T; 368/30, 62, 69, 89, 107, 111, 113; 324/186; 235/92 T

[56] References Cited

U.S. PATENT DOCUMENTS

| | | | |
|---|---|---|---|
| 3,982,387 | 9/1976 | Tanaka | 58/4 A |
| 3,992,871 | 11/1976 | Namabe | 58/127 R |
| 4,067,185 | 1/1978 | Huguenin | 58/4 A |

*Primary Examiner*—Edith S. Jackmon

*Attorney, Agent, or Firm*—Jordan and Hamburg

[57] ABSTRACT

A digital electronic timepiece which comprises an oscillator circuit providing a relatively high frequency signal, a frequency divider dividing down the relatively high frequency signal to provide a first low frequency signal representative of the count of one second and a second low frequency signal higher in frequency than the first low frequency signal and representative of the count less than one second, a first counter responsive to the first low frequency signal to provide time and calendar information signals; and an additional data signal a second counter responsive to the second low frequency signal to provide output signals representative of the count less than one second, first display means for displaying time and calendar data in response to the time and calendar information signals, second display means composed of a plurality of display segments for displaying data representative of the count less than one second in step-wise fashion in response to the output signals from the second counter, said display segments serving as means for displaying additional data, and switching means for enabling said second display means to display said additional data.

7 Claims, 18 Drawing Figures

Fig. 3
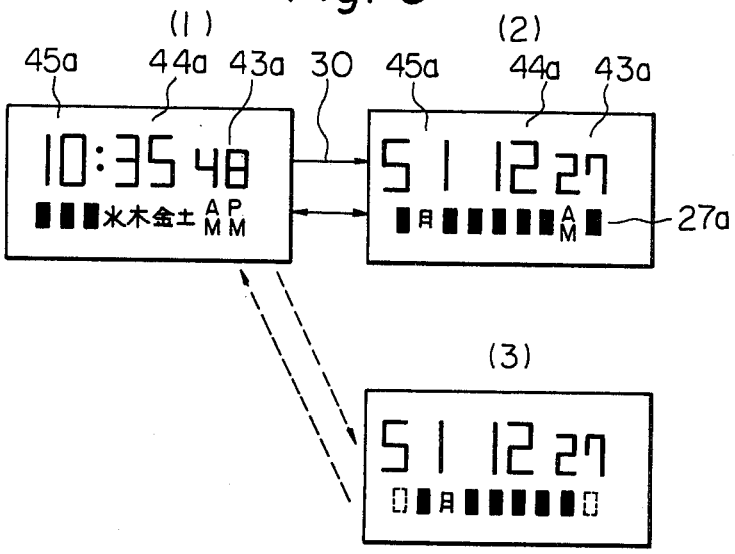
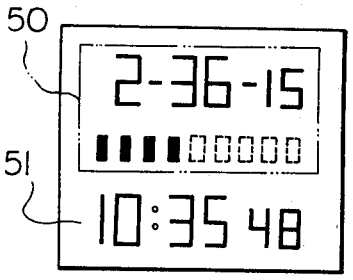
Fig. 5
Fig. 7
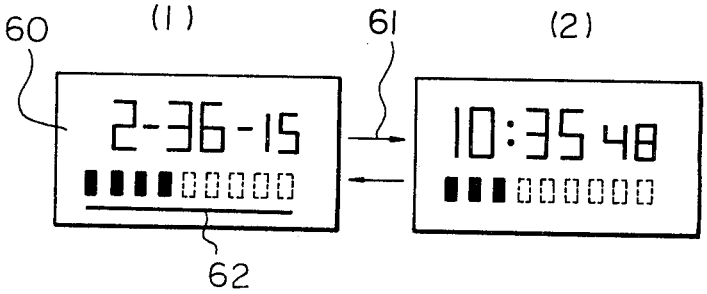

DIGITAL ELECTRONIC TIMEPIECE

This is a continuation of application Ser. No. 784,742, filed Apr. 5, 1977, now abandoned.

This invention relates to electronic timepieces and, more particularly, to a digital electronic timepiece which can serve as a chronograph.

Due to recent development in crystal oscillators and electronic components of a high quality, timepiece accuracy is highly improved so that daily timekeeping error can be kept within 0.05 seconds. Recent trend in the filed of digital electronic timepieces requires that the timepiece provide various functions such as a stopwatch otherwise known as a chronograph, a calendar function as well as a normal timekeeping function. In conventional digital electronic timepieces, it has been a usual practice to have the timepiece equipped with a numeral display section independently of display sections for a normal timekeeping data and calendar data. This makes it difficult to read chronograph information because of its rapid changes in displayed data.

It is, therefore, an object of the present invention to provide a digital electronic timepiece adapted to provide a stage-like or step-wise display without using numeral segments, thereby providing ease of reading displayed data and affording a unique, dynamic design.

It is another object of the present invention to provide a digital electronic timepiece in which a static and dynamic driving method can be applied to the same liquid crystal cell.

It is another object of the present invention to provide a digital electronic timepiece which is simple in construction and low in manufacturing cost.

These and other objects, features and advantages of the present invention will become more apparent from the following description when taken in conjunction with the accompanying drawings, in which:

FIGS. 1(1), 1(2), 1(3), 1(4), 1(5), and 1(6) show plan views of the faces of a liquid crystal display device of a digital electronic timepiece according to the present invention;

Figure 4:
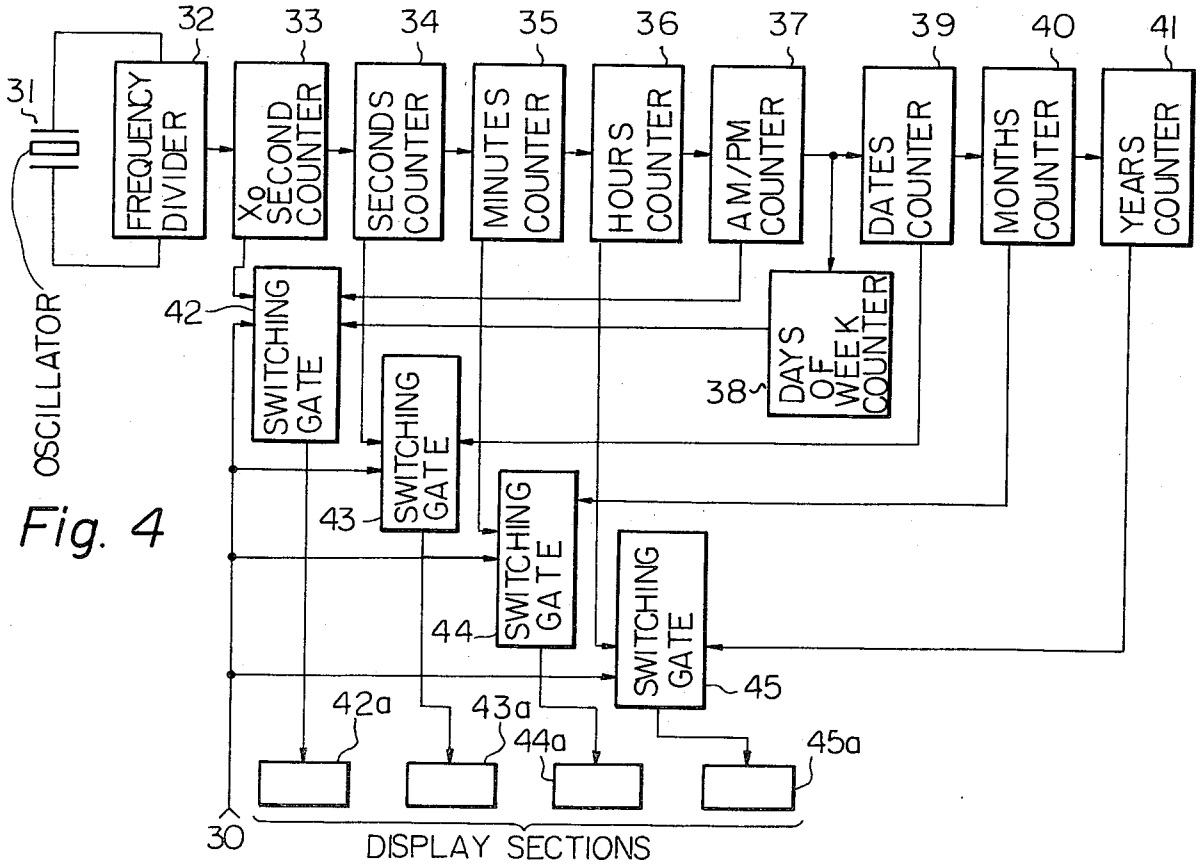
Figure 6:
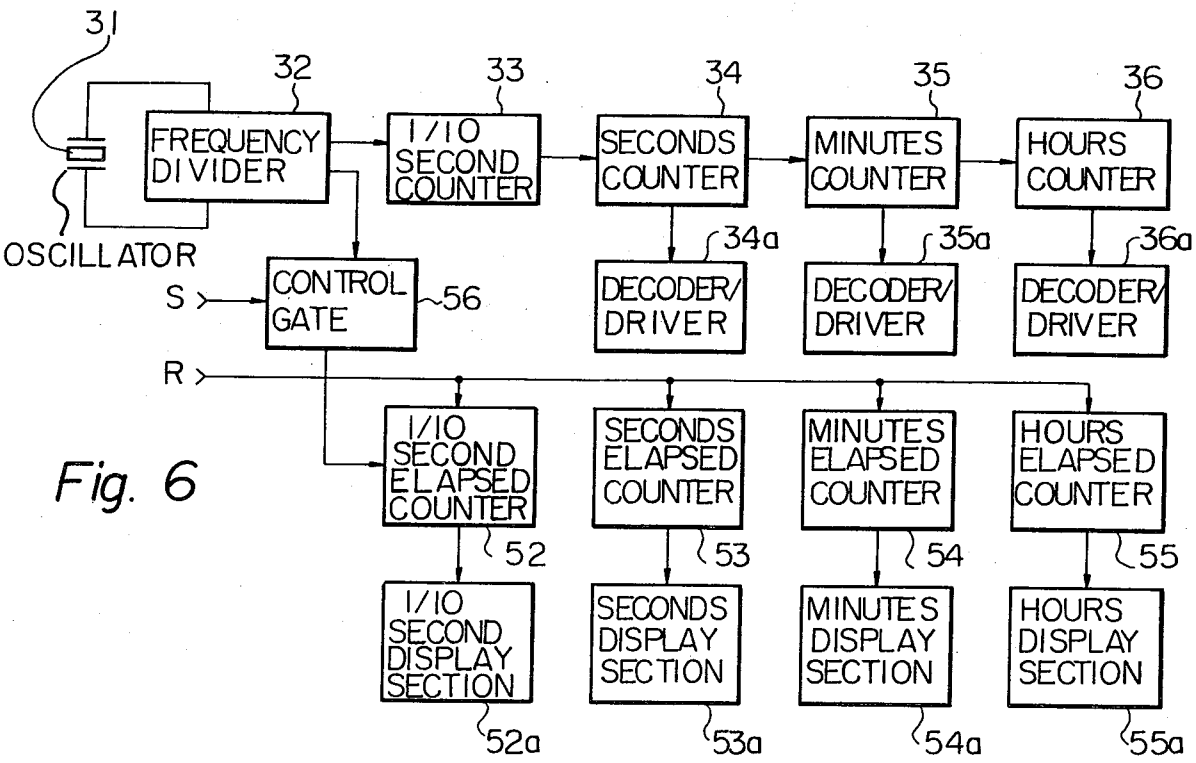
Figure 8:
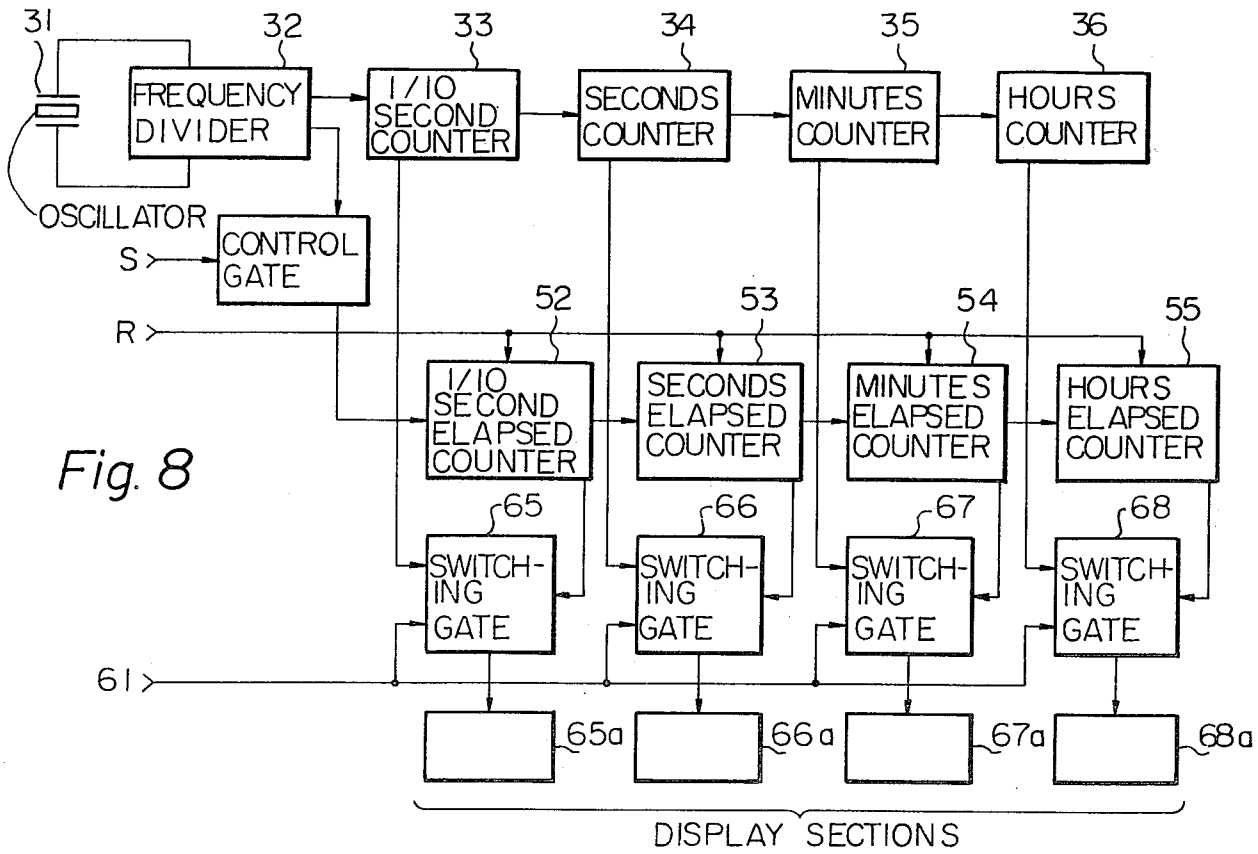

FIG. 3(1) 3(2) and 3(3) show plan views illustrating the faces of a liquid crystal display device of another preferred embodiment of a digital electronic timepiece according to the present invention;

FIG. 4 is a block diagram of the electronic timepiece shown in FIG. 3;

FIG. 5 is a plan view illustrating the face of a liquid crystal display device of another preferred embodiment of a digital electronic timepiece according to the present invention;

FIG. 6 is a block diagram of the electronic timepiece shown in FIG. 5;

FIG. 7(1) and 7(2) show plan views the face of a liquid crystal display device of another preferred embodiment of a digital electronic timepiece according to the present invention;

FIG. 8 is a block diagram of the electronic timepiece shown in FIGS. 7(1) and 7(2)

Figure 9:
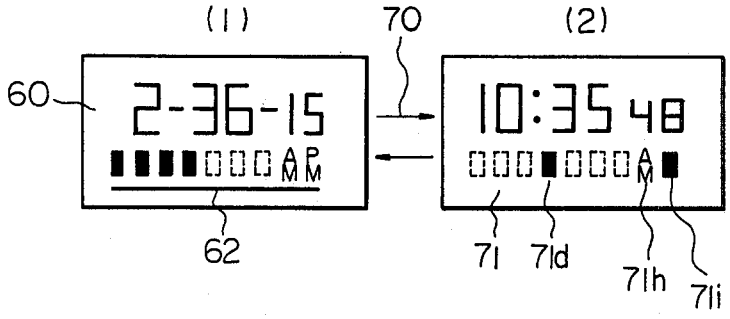
Figure 10:
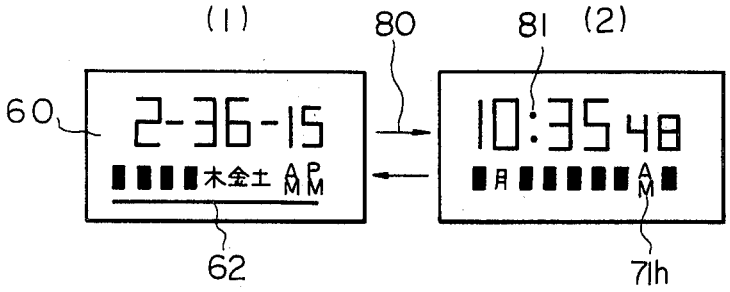
Figure 11:
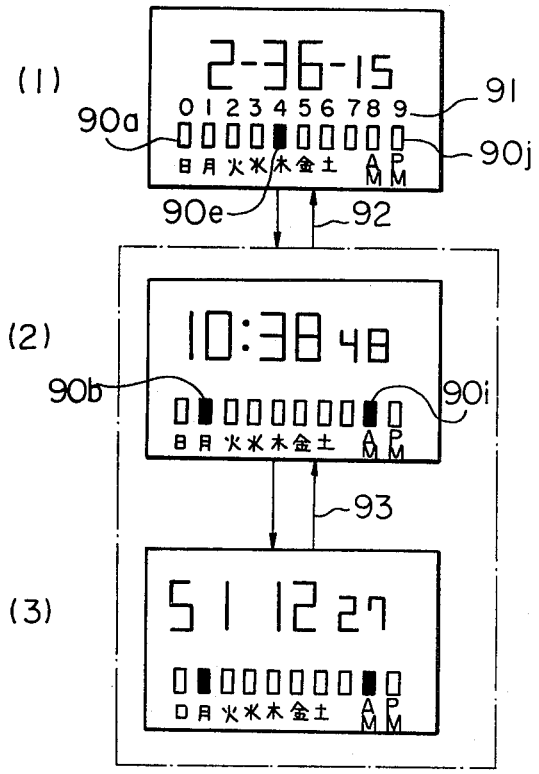
Figure 12:
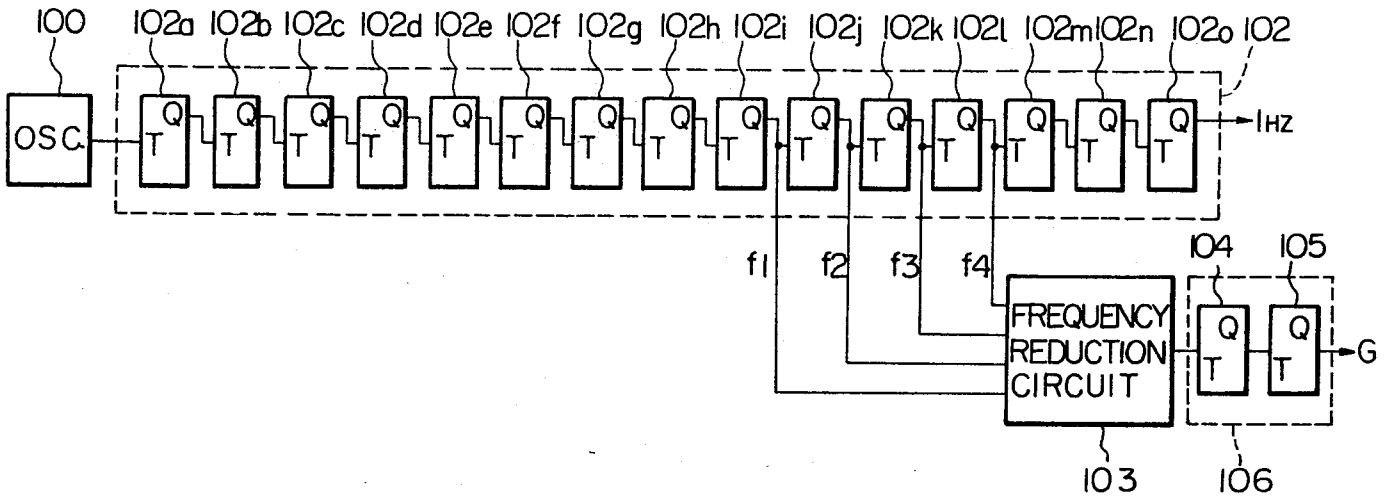
Figure 13:
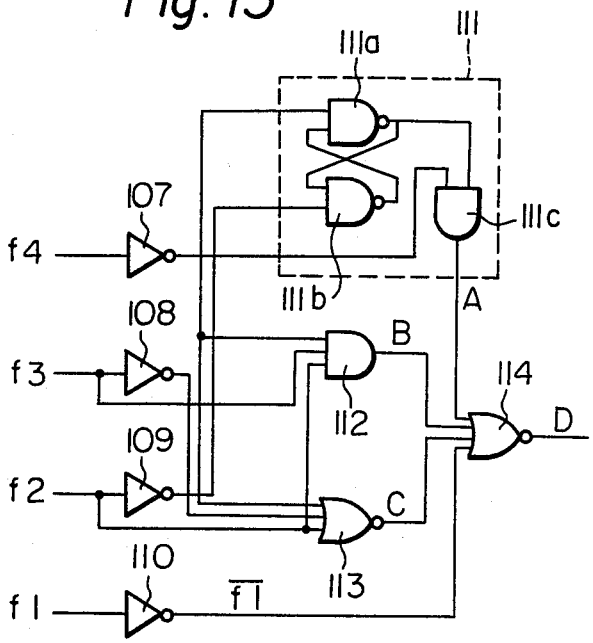
Figure 14:
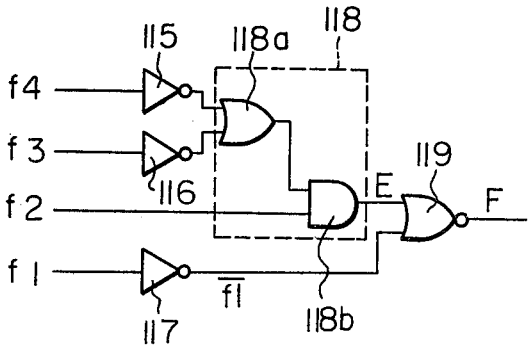
Figure 15:
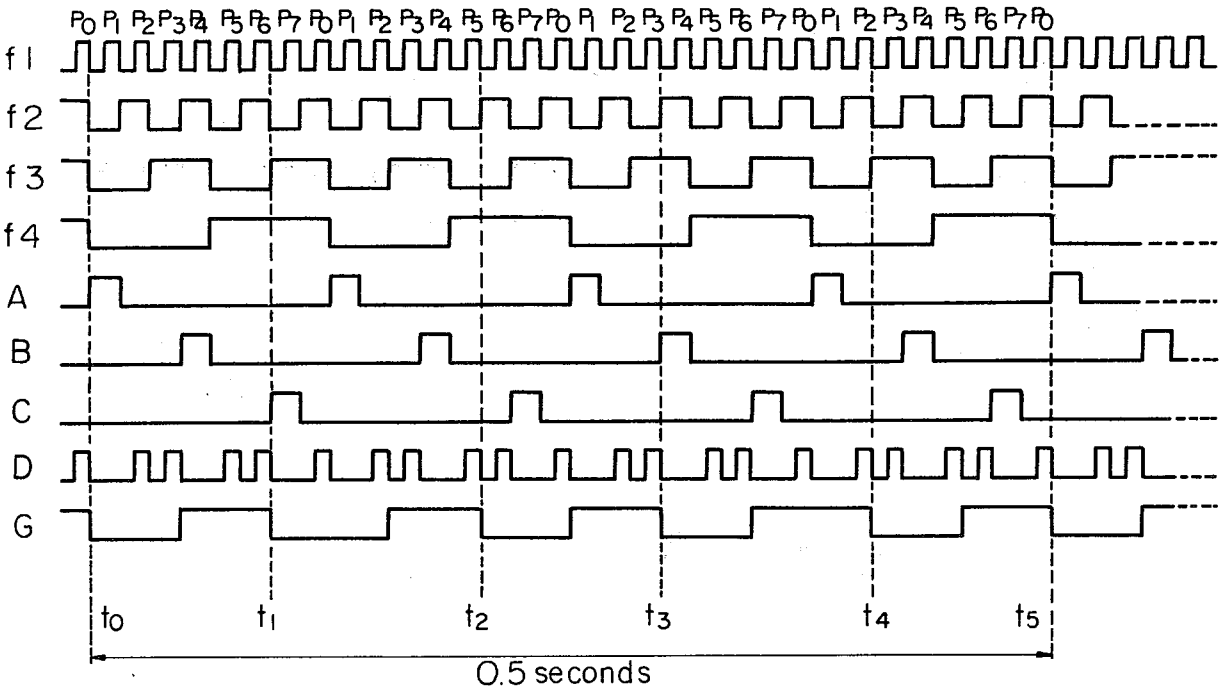
Figure 16:
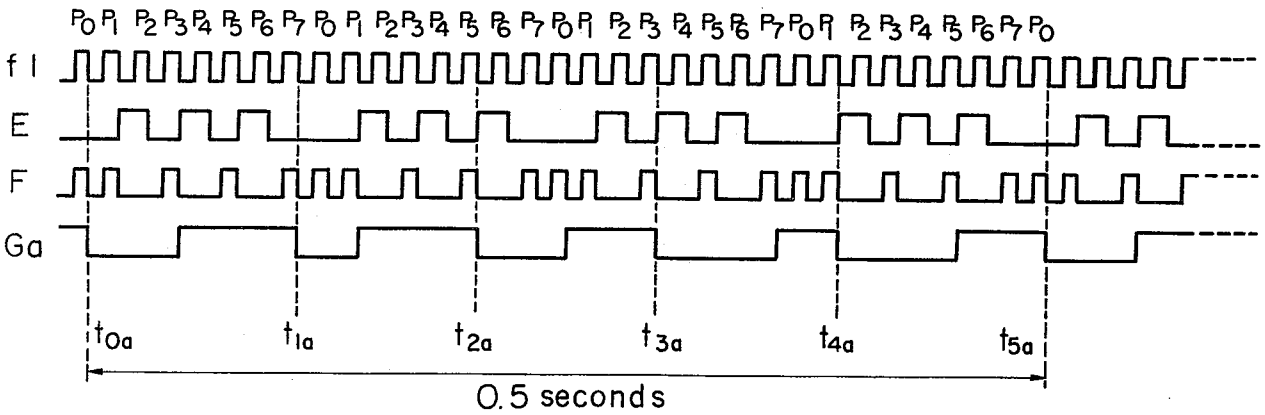
Figure 17:
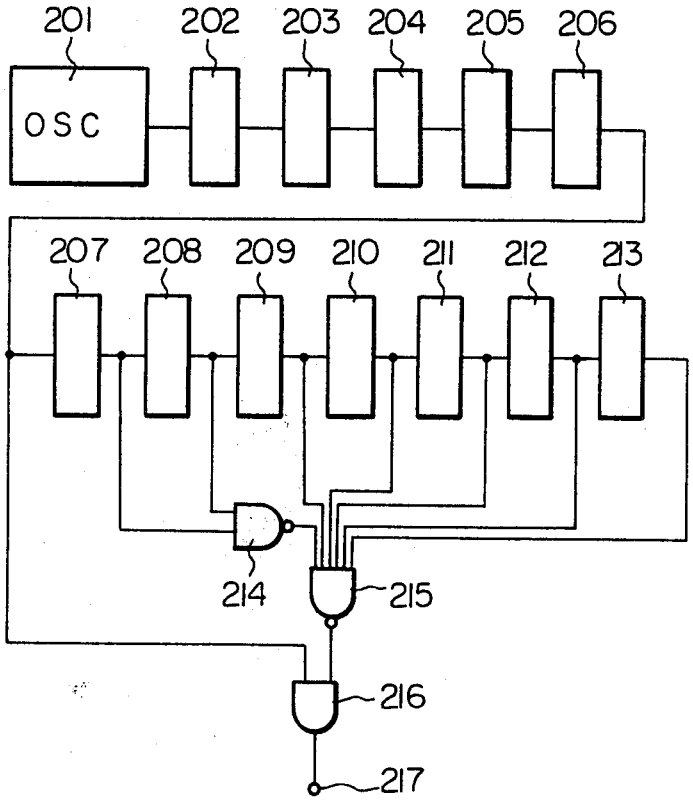

FIG. 9(1) and 9(2) show plan views of the faces of a liquid crystal display device of another preferred embodiment of a digital electronic timepiece according to the present invention;

FIGS. 10(1) and 10(2) show plan views of the faces of a liquid crystal display device of another preferred embodiment of a digital electronic timepiece according to the present invention;

FIGS. 11(1) 11(2) and 11(3) show plan views of the faces of a liquid crystal display device of another preferred embodiment of a digital electronic timepiece according to the present invention;

FIG. 12 is a block diagram of another preferred embodiment of a digital electronic timepiece according to the present invention;

FIG. 13 is a detail circuitry for a part of the electronic timepiece shown in FIG. 12;

FIG. 14 is a detail circuitry illustrating a modification of the circuit shown in FIG. 13;

FIG. 15 is a timing chart for the waveforms of various signals generated by the circuit of FIG. 13;

FIG. 16 is a timing chart for the waveforms of various signals produced by the circuit of FIG. 14; and FIG. 17 is a block diagram of another preferred embodiment of an electronic timepiece according to the present invention.

Figure 1:
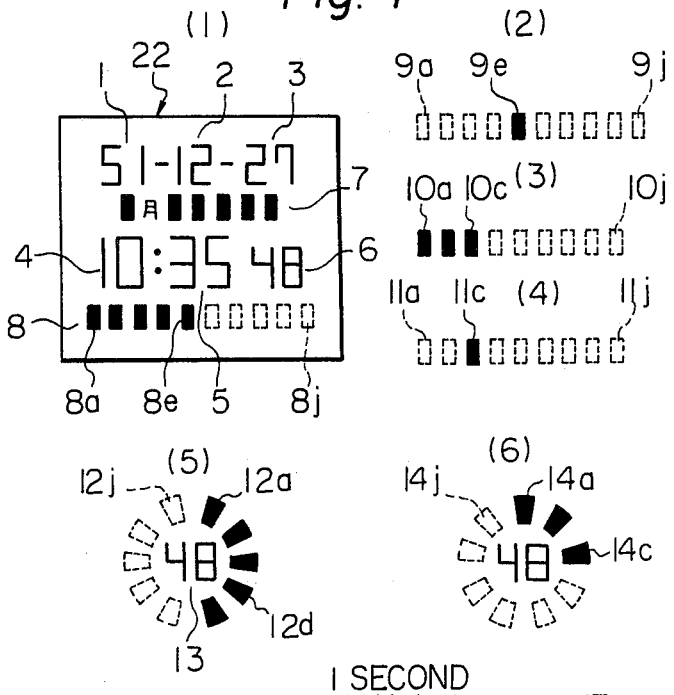

FIG. 1(1) shows the face of a liquid crystal display 22 which simultaneously displays time and calendar information. Reference numerals 1 through 6 respectively designate years, months, date, hours, minutes and seconds in the form of numerals. Reference numeral 7 denotes a band of seven segments for a days of the week display. Here, one of the segments is extinguished so as to reveal a character printed on a reflective plate or the like. A system is adopted in which the extinguished point is shifted or transposed from day to day in a continuous manner. Reference numeral 8 denotes a band of ten segments for a step-wise display in units of 1/10 second. In other words, from segment **8*a* to segment 8*j* the cumulative illumination of successive segments indicates the passage of time in units of 1/10 second so that 0/10, 1/10, 2/10 . . . can be displayed. In the state shown, all of the segments up to and including segment 8*e* are illuminated thereby showing the passage of 4/10 of one second. FIG. 1(2) illustrates another example of a 1/10 second step-wise display in which individual segments from 9*a* to 9*j*** are illuminated one at a time so that a shift of transposition is made from one segment to another so that 0/10, 1/10, 2/10 can be displayed. In this case also the passage of 4/10 of one second is shown.

It is possible according to the invention to start either the cumulative or transposed display from the right as well as the left hand side and then reverse the direction of illumination every second so that the segments will illuminate in one direction for one second and then illuminate and return in the opposite direction for the next second.

FIG. 1(3) depicts another example of the display face in which a band of nine segments **10*a* through 10*j* indicating 1/10 second increments are illuminated step-wise and remain illuminated this providing a cumulative-type display. 0/10 second is indicated when all of the segments are extinguished. Each illuminated segment represents 1/10 second. In the diagram, segments 10*a* to 10*c* are illuminated thereby indicating 3/10 of one second. FIG. 1(4) is still another example of the invention in which a band of nine segments 11*a* to 11*j* indicating 1/10 second increments are individually illuminated one at a time so that a shift is made from segment to adjacent segment thus providing a transposed display. 0/10 second is indicated when all of the segments are extinguished. Here, segments are illuminated one at a time from the left at increments of 1/10 second, and once again 3/10 of one second is illustrated since segment 11***c* is illuminated.

In the step-wise transposed display of FIGS. 1(2) and (4), there are cases where sufficient contrast is not obtained because the time interval required for one segment to shift to another is too short with respect to liquid crystal response. In other words, the extenguishment of a segment is not completed before the succeeding segment is illuminated. There is thus an operation in which extinguishment is delayed until illumination is assured, namely an operation in which other successive segments are simultaneously illuminated. These are shifted as a group so as to display the passage of time. There is also a method in which a specified segment is illuminated when the time is stopped.

Until the above occurs the progress of time is displayed by illumination although it is also possible to express this in reverse manner by means of showing extinguishment. FIG. 1(5) shows 10 segments 12*a* to 12*j* arranged in circular fashion. This is a step-wise cumulative display system in which segments indicative of 1/10 seconds are successively illuminated in the clockwise direction at increments of 1/10 second so that 0/10, 1/10, 2/10 . . . seconds can be displayed. In the state shown, segments 12*a* through 12*d* are illuminated thereby indicating an elapsed time of 3/10 of one second. Reference numeral 23 denotes two digits for the purpose of displaying seconds units in terms of numerals. It is of course permissible to leave the center of the circle blank or insert information other than seconds information.

FIG. 1(6) shows nine segments 24*a* through 24*j* arranged in circular fashion. This a step-wise cumulative display in which segments indicative of 1/10 second are successively illuminated in the clockwise direction at increments of 1/10 second so that 1/10, 2/10 . . . seconds can be displayed. 0/10 second is indicated when all of the segments are extinguished. In the state shown, segments 14*a* through 14*c* are illuminated thereby indicating an elapsed time of 3/10 of one second. It is of course possible to adopt a step-wise transposed display and one in which the progress of time can be displayed by means of extinguishment. The direction of illumination or extinguishment may be either clockwise or counterclockwise although it goes without saying that the clockwise direction is in keeping with tradition. In addition, the circular arrangement may be replaced by another such as a square configuration.

Figure 2A:
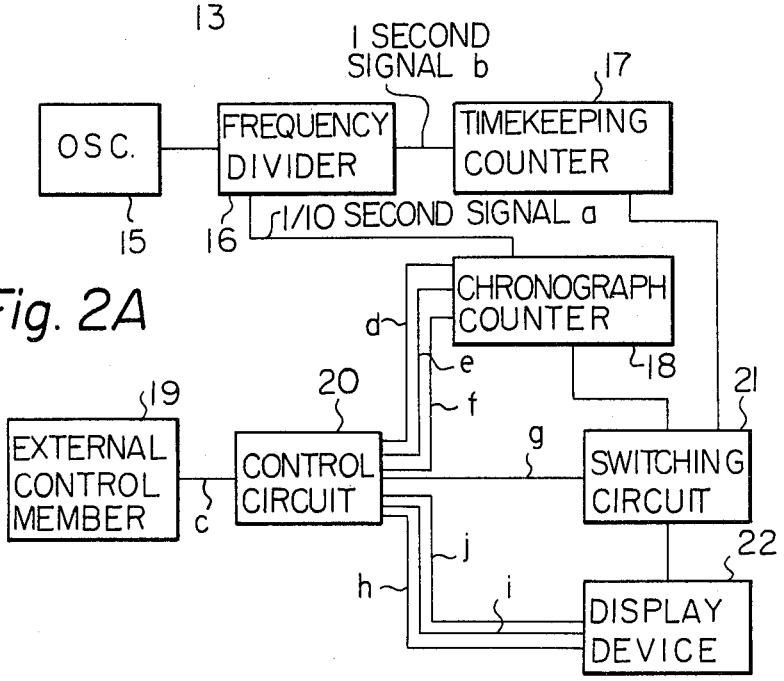
FIG. 2A is a block diagram of the digital electronic timepiece shown in FIGS. 1(1), 1(2) 1(3), 1(4), 1(5) and 1(6)

FIG. 2A shows a block diagram of the digital electronic timepiece shown in FIG. 1(1). In FIG. 2A, the digital electronic timepiece comprises an oscillator circuit 15 controlled by a quartz crystal (not shown) to provide a relatively high frequency signal of, for example, 32,768 Hz. This relatively high frequency signal is divided down by a frequency divider 16 to a 1/10 second signal a and one second signal b. The one second signal b is applied to a timekeeping counter 17 composed of a seconds counter, minutes counter, hours counter, AM/PM counter, days of week counter, dates counter, months counter and years counter all of which are (not shown) which produce a seconds signal, minutes signal, hours signal, AM/PM signal, days of the week signal, dates signal, months signal and years signal. The 1/10 second signal a is applied to a chronograph counter 18 composed of 1/10 counter (not shown) by which output signals are generated in units of 1/10 second so that outputs representative of 0/10, 1/10, 2/10 . . . of one second can be obtained. The electronic timepiece also comprises an external control member 19 composed of one or plurality of switches adapted to generate various switching signals, which are applied to a control circuit 20. The control circuit 20 is arranged to generate a start signal d to start the chronograph counter 18, a stop signal e to stop the same, and a reset signal f to reset the chronograph counter 18 in response to the switching signal c delivered from the external control member 19. When the start signal d is applied to the chronograph counter 18, it generates 0/10, 1/10, 2/10 . . . signals during a time interval in which the start signal d is at a high logic level. During the time interval in which the start signal d is generated, the switching circuit 21 allows to pass the output signals from the chronograph counter 18 to the display device 22 in response to a control signal g. A chronograph display signal h is also applied to the display device 22 from the control circuit 20. Chronograph display signal h goes to the low logic level upon the initiation of the start signal d and remains at that level until the initiation of a subsequent stop signal e, whereupon signal h goes to the high logic level and remains at that level. Under these circumstances, the band 8 of segments of the display device 22 provides a step-wise display for the data of the chronograph counter 18 in units of 1/10 second.

When the control signal g goes to a low logic level, the switching circuit 21 permits to pass the output signals from the timekeeping counter 17 to the display device 22 so that the data of the timekeeping counter 17 is displayed. Indicated as i is an AM/PM display enabling signal and j a days of week display enabling signal.

Figure 2B:
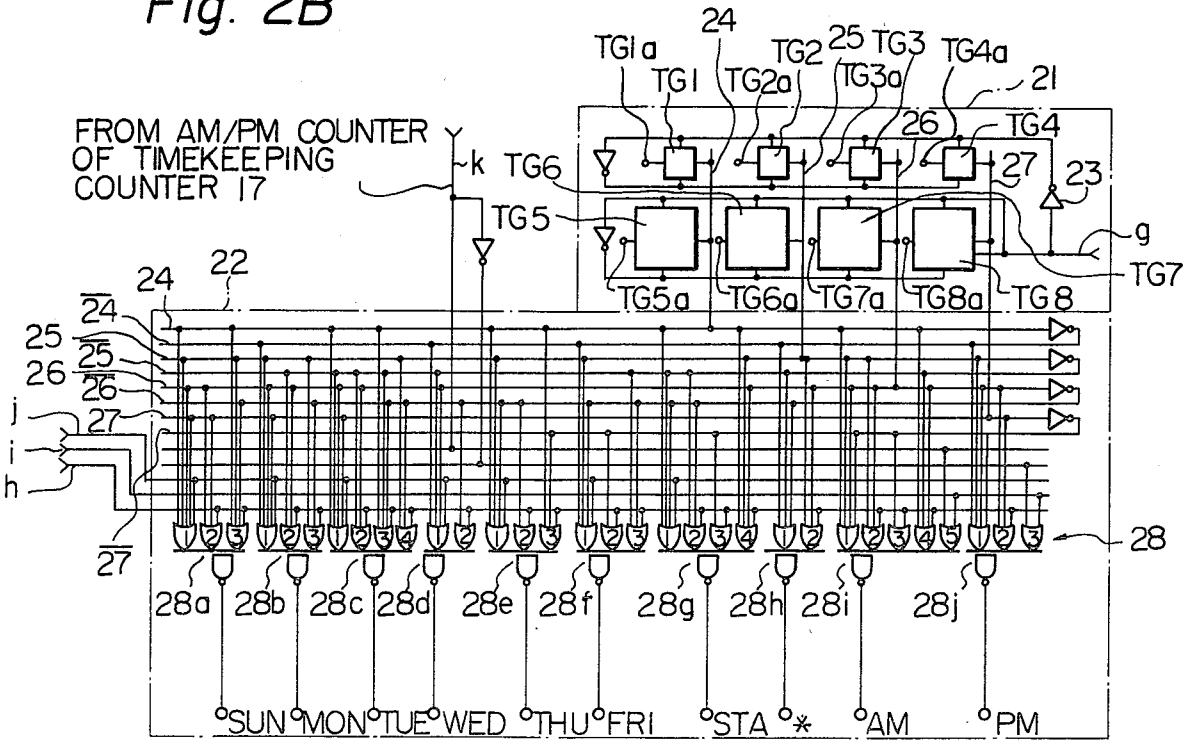
FIG. 2B is a detail circuitry for a part of the electronic timepiece shown in FIG. 2A.

FIG. 2B shows an example of a detail circuitry of an essential portion of the timepiece shown in FIG. 2A. The switching circuit 21 is shown as comprising a first group of transmission gates TG1 through TG4 having respective control gates coupled through an inverter 23 to lead g connected to the control circuit 20 (see FIG. 2A). The transmission gates TG1 through TG4 have data input terminals TG1*a* through TG4*a* which are connected to the days of week counter (not shown) of the timekeeping counter 17. During normal operating condition of the timepiece, since the control signal g is at a low logic level, the first group of the transmission gates TG1 through TG4 are turned on so that outputs of the days of the week counter are passed to output leads 24 through 27. The switching circuit 21 also comprises a second group of transmission gates TG5 through TG8 having their respective data input terminals TG5*a* through TG8*a* coupled to the chronograph counter 18 and controlled by the control signal g generated by the control circuit 20. When the chronograph counter 18 is started, the control signal g goes to a high logic level and the transmission gates TG5 through TG8 are turned on so that the outputs of the chronograph counter 18 are passed through output leads 24 through 27, respectively to a decoder 28. In this manner, the outputs of the days of week counter and the chronograph counter are selectively passed through the switching circuit 21 to the decoder 28 of the display device 22. The decoder 28 is composed of a plurality of decoding circuits 28*a* through 28*j*. The decoding circuit 28*a* is composed of a first OR gate OR1 having first through fourth inputs connected to the output leads 24 through 27, respectively, and a fifth input connected to the control circuit 20 to receive the days of week display enabling signal j; a second OR gate OR2 having a first input connected to the output lead 26, a second input connected to the output lead 27, and a third input connected to the control circuit 20 to receive the chronograph data display enabling signal h; and a third OR gate OR3 having first, second, third and fourth inputs coupled to leads 24, 25, 26 and h. Outputs of these OR gates are connected to inputs of a NAND gate whose output is coupled to an output terminal labeled SUN. Similarly, the decoding circuit 28*b* comprises three OR gates and a NAND gate having its output coupled to a terminal laveled MON. The decoding circuit 28*c* comprises four OR gates and a NAND gate whose output coupled to a terminal labeled TUE. The decoding circuit 28*d* comprises two OR gates and a NAND gate labeled WED. The decoding circuit 28*e* comprises three OR gates and a NAND gate whose output coupled to a terminal labeled THU. Similarly, outputs of respective NAND gates of the decoding circuits 28*f* through 28*j* are connected to terminals labelled FRI, STA, *, AM and PM, respectively. The AM/PM data from the AM/PM counter of the timekeeping circuit 17 is applied to lead k to which one input of a fifth OR gate OR5 of the decoding circuit 28*i* is directly coupled and one input of an OR gate OR3 of the decoding circuit 28*j* is also coupled through an inverter (no numeral).

During the days of week data display, the control signal g is at a low logic level and, therefore, the first group of transmission gates TG1 through TG4 are turned on. In this condition, the outputs of the days of week counter of the timekeeping circuit 17 are applied through output leads 24 through 27 to the decoding circuits 28*a* through 28*j*, respectively. Also, the AM/PM signal k is applied to the decoding circuits 28*a* through 28*j*. Since, in this instance, the chronograph data display enabling signal h is at a high logic level, closing the OR gates OR2 and OR3 of the decoding circuit 28*a*, OR gates OR2 and OR3 of the decoding circuit 28*b*, or gates OR2, OR3 and OR4 of the decoding circuit 28*c*, OR gate OR2 of the decoding circuit 28*d*, OR gates OR2 and OR3 of the decoding circuit 28*e*, OR gates OR2 and OR3 of the decoding circuit 28*f*, OR gates OR2, OR3 and OR4 of the decoding circuit 28*g*, OR gate OR2 of the decoding circuit 28*h*, OR gates OR2, OR3 and OR4 of the decoding circuit 28*i*, and OR gate OR2 of the decoding circuit 28*j*. Consequently, one of the OR gates OR1 of the decoding circuits 28*a* through 28*g* is selected in accordance with the content of the days of week counter and an output of the corresponding decoding circuit is applied through the output terminal to the display segment (not shown) by which the content of the days of week counter is displayed. At the same time, one of the OR gate OR5 of the decoding circuit 28*i* and the OR gate OR3 of the decoding circuit 28*j* is selected in response to the signal k and AM or PM is displayed.

During the chronograph data display, the control signal g is at a high logic level. Accordingly, the first group of transmission gates TG1 through TG4 are turned off whereas the second group of transmission gates TG5 through TG8 are turned on. Therefore, the outputs of the chronograph counter (1/10 second counter) 18 are applied to the decoding circuits 28*a* through 28*j*. Since, in this instance, the AM/PM display enabling and flashing signal is at a high of the decoding circuit 28*j* are closed. When the chronograph is an run-on condition, the chronograph data display enabling signal h is at a low logic level, and the decoding circuit 28*a* is selected when the content of the 1/10 second data remains in a range from 0/10 to 4/10. Similarly, the decoding circuits 28*b*, 28*c*, 28*d*, 28*e*, 28*g*, 28*i* and 28*j* are selected when the 1/10 second data remains in ranges of from 1/10 to 5/10, from 2/10 to 6/10, from 3/10 to 7/10, from 4/10 to 8/10, from 5/10 to 9/10, from 6/10 to 9/10 and 0/10, from 7/10 to 9/10, 0/10 and 1/10, from 8/10 to 9/10 and from 0/10 to 2/10, and 9/10 and from 0/10 to 3/10. When the chronograph is stopped, the chronograph data display signal enable signal goes to a high logic level. Since, in this condition, only the OR gates OR1 of the decoding circuits 28*a* through 28*j* are opened, one of the OR gates 1 of the decoding circuits is selected in dependence on the content of the chronograph counter 18 at the time instant when the chronograph is stopped. Thus, the output from the selected decoding circuit is applied through its output terminal to the corresponding display segment by which the content of the chronograph counter is displayed.

FIGS. 3 (1), 3(2) and 3(3) show the face of a display in which a switch is made from a time to a calendar display. FIG. 3(1) shows a case in which hours, by nine segments which are illuminated in a step-wise, cumulative fashion, with 3/10 of one second of elapsed time indicated in the present drawing. The application of a switch signal 30 switches the time display of FIG. 3(1) to the calendar display of FIG. 3(2). The application of the same signal reverses the display to its original state. In the calendar of FIG. 3(2) the display numerals for the months, date and days presentation are common with the digits used for the hours, minutes and seconds of the time display. The days of the week display adopts a system in which the segments are extinguished in step-wise fashion with the illuminated segment shifting from day to day. Of the nine segments which comprise the 1/10 seconds display the first seven are adapted to reveal the printed characters of the day of the week while the last two are for the AM-PM display. In pace of the arrangement of FIG. 3(2), FIG. 3(3) shows a case where the seven central segments are employed for the days of the week display while the two segments at either end are left for some other purpose.

FIG. 4 depicts a block diagram to explain the switch-over from a time display to the calendar display of FIG. 3(2). Reference numeral 31 denotes a quartz oscillator and reference numeral 32 a frequency divider which supplies a 1/10 second signal to a 1/10 second counter 33. Reference numeral 34 designates a seconds counter, 35 a minutes counter, 36 an hours counter, 37 an AM-PM counter (a divide by 12 counter for determining AM and PM), 38 a days of the week counter, 39 a dates counter, 40 a months counter and 41 a years counter. Reference numeral 42 denotes a switching gate for switching among 1/10 second counter 33, AM-PM counter 37 and days of the week counter 38, reference numeral 43 denotes a switching gate for switching between seconds counter 34 and years counter 41, reference numeral 44 designates a switching gate for switching between minutes counter 35 and dates counter 39, and reference numeral 45 denotes a switching gate for switching between hours counter 36 and years counter 39. Switching signal 30 simultaneously selects either a time mode or calendar mode, and display sections 42*a* to 45*a* display the mode so selected. Display section 42*a* has nine segments as illustrated in FIG. 3(2), and makes joint use of a 1/10 second step-wise display, an AM-PM display, and a days of the week display. Display sections 43*a* to 45*a* have segments in the form of numerals which display the selected time system or calendar system shown in FIGS. 3(1) and (2).

Although the calendar display according to the above-mentioned switching method is somewhat complicated, this is permitted in wristwatches and is also advantageous in that an easy-to-read, comparatively large pattern with respect to the limited display area can be used. However, the main advantage resides in the fact that only 25 electrodes are necessary if a static step-wise display section and a dynamic numerical display section are adopted.

Next, an electronic timepiece will be described which is provided with a stop-watch function applied to a 1/10 second step-wise display. In other words, a digital timepiece with a chronograph function is as depicted in FIG. 5. Here, reference numeral 50 denotes an elapsed time display section in which hours, minutes and seconds are displayed by numerical segments, while units of 1/10 second are represented by a band of nine segments which are illuminated step-wise in a cumulative manner. Among the step-wise display arrangements it is also possible to employ a circular array as previously described. Reference numeral 51 denotes a time display section in which hours, minutes and seconds are represented by numerals.

FIG. 6 is a block diagram for an explanation of the timepiece shown in FIG. 5. Reference numerals 31 to 36 designate the same components as previously described with reference to FIG. 4. Reference numeral 34*a*, 35*a* and 36*a* designate decoder drivers for seconds, minutes and hours, respectively. Reference numeral 52 denotes a 1/10 second counter for elapsed time, 53 a seconds counter, 54 a minutes counter and 55 an hours counter. Reference numeral 52*a* designates a step-wise display section for units of 1/10 second, and reference numerals 53*a* to 55*a* denote numeral display sections for seconds, minutes and hours. Reference numeral 56 designates a control gate which decides whether to pass or block a counting signal supplied by frequency divider 32. Control gate 56 is operated by a signal S. R denotes a reset signal which resets the elapsed time counter to 0. If a latch circuit (not shown) is added to the elapsed time counter it is also possible to provide a lap measuring function.

Although this is a method of simultaneously displaying over the same display area both elapsed time and actual time, display elements and wiring raise the cost even if dynamic driving is adopted. However, if the timepiece is a wristwatch, it is permissible to switch between elapsed time and actual time and then display the mode so selected. FIGS. 7(1) and 7(2) are such an example.

In FIGS. 7(1) and 7(2) there are shown a display device for a digital electronic timepiece with a chronograph function that can be switched to at will. FIG. 7(1) shows an elapsed time display in which hours, minutes and seconds of elapsed time are represented by numerals while elapsed time measured in units of 1/10 of a second is accomplished by step-wise, cumulative illumination of the band of segments. FIG. 7(2) shows a time display in which hours, minutes and seconds are represented by numerals while units of 1/10 second are represented by the band-like segments which are illuminated step-wise in cumulative fashion. These two displays are selected by a switching signal 61 which is produced by the manipulation of an external control switch. Reference numeral 62 denotes a reference segment which distinguished the elapsed time display from the actual time display so that the two are not mistaken for each other. This segment may take any form whatsoever and can equally well be provided at the side of the actual display or in any desirable location. In order to further distinguish the displays it is also possible to adopt the cumulative and transposed methods for the 1/10 second step-wise display, adapt a system in which the passage of time is shown by illumination or extinguishment, and by selecting a desired direction for showing the passage of time or by allowing time to progress first in one direction and then the other. Although segment 60 makes use of band-like segments, a circular arrangement may be adopted as previously mentioned.

FIG. 8 depicts a block diagram for a description of the contents of a digital electronic timepiece equipped with a chronograph function which is selected by a switching operation. Reference numerals 31 to 36 and 52 to 55 designate the same components as previously described. Reference numerals 65, 66, 67 and 68 designate switching gates for switching between signals from 1/10 second counter and 1/10 second elapsed time counter 52, between signals from seconds counter 34 and seconds elapsed time counter 53, between signals from minutes counter 35 and minutes elapsed time counter 54, and between hours time counter 36 and hours elapsed time counter 55, respectively. Switching signal 61 simultaneously selects either actual time or elapsed time, and display sections 65*a* to 68*a* display the mode so selected. Display section 65*a* has a row of nine segments 60 as illustrated in FIGS. 7(1) and (2). These serve to display in step-wise fashion 1/10 second units of time or 1/10 second units of elapsed time.

FIG. 9(1) depicts a display for elapsed time in which hours, minutes and seconds are represented by numerals while elapsed time in units of 1/10 second is shown by a band of nine segments. Here, 4/10 seconds or elapsed time is indicated. FIG. 9(2) shows a display for actual time in which the data appears in the position previously occupied by seconds of elapsed time. Reference numeral 71 denotes a band of nine segments of which six are used to represent time in units of 10 seconds each. In the system adapted here each of these six segments is individually illuminated so that the time as displayed shifts step-wise from segment to segment. In FIG. 9(2), segment 71*d* indicates time between the 30 and 40 seconds by flashing at a frequency of 1 Hz. Reference numerals 71*h* and 71*i* are the two remaining segments of the nine segment display and are employed to indicate AM and PM. If a twist liquid crystal is utilized these segments can be made to display the characters printed on a reflective plate or the like. In the diagram, segment 71*h* indicates AM. Reference numeral 70 denotes a switching signal generated by the manipulation of an external control switch, and reference numeral 62 designates a segment which allows the displays to be distinguished from each other, as previously described.

FIG. 10(1) depicts a display for elapsed time and, as in FIGS. 9(1) and 9(2) shows that 4/10 second of time has elapsed. FIG. 10(2) illustrates a display for actual time which has nine segments, seven of which are used to denote the days of the week while the remaining two are for an AM/PM display. Reference numeral 81 designates a flashing colon, and 80 a switching signal generated by the manipulation of an external control switch. Reference numeral 62 once again denotes a segment for distinguishing between displays.

FIG. 11(1) shows an elapsed time display for a chronograph in which hours, minutes and seconds are represented by numerals composed of a plurality of segments. For the 1/10 second units display, segments are disposed within 10 printed frames 90*a* through 90*j*, each of these segments being illuminated individually so that illumination shifts from segment to adjacent segment. A row of printed numeral segments 91 ranging from 0 to 9 along the 1/10 second segments are for the purpose of reading the elapsed time as it is displayed by the segments which are illuminated. As can be appreciated from the diagram, 4/10 seconds of time have elapsed. In addition, characters representative of days of the week and AM/PM have been printed on the face of the liquid crystal display. Although the row of numerals 91 may be printed as shown, they may be arranged to only appear on the display for elapsed time. In FIGS. 11(2) and (3) a modification is made in which the numerals do not appear.

FIG. 11(2) depicts a time display and FIG. 11(3) a calendar display. These display states are switched to from the elapsed time display state by a switching signal 92 formed by manipulating an external switch. Reference numeral 90b in FIG. 11(3) makes use of a 1/10 second elapsed time display segment of FIG. 11(1). In the diagram, days of the week are displayed, and reference numeral 90i designates an AM segment which is shown to be illuminated. FIG. 11(3) shows a calendar display which is switched to from the time display by means of a switch signal 93 provided by the manipulation of a different external control switch. Here, year, month and data are displayed without changing the day of the week or AM/PM information depicted in FIG. 11(2).

FIG. 12 illustrates a block diagram of another preferred embodiment of an electronic timepiece in accordance with the invention. Reference numeral 100 denotes a crystal controlled oscillator with a frequency of 32,768 Hz, and reference numeral 102 designates a 15 stage frequency divider comprised of dividers 102*a* through 102*o*. The frequency of the output signals obtained from each of these stages is as follows:

divider 102*a* . . . 16384 Hz
divider 102*b* . . . 8192 Hz
divider 102*c* . . . 4096 Hz
divider 102*d* . . . 2048 Hz
102*e* . . . 1024 Hz
102*f* . . . 512 Hz
102*g* . . . 256 Hz
102*h* . . . 128 Hz
divider 102*i* . . . 64 Hz=f1
divider 102*j* . . . 32 Hz=f2
divider 102*k* . . . 16 Hz=f3
divider 102*l* . . . 8 Hz=f4
divider 102*m* . . . 4 Hz
divider 102*n* . . . 2 Hz
divider 102*o* . . . 1 Hz Therefore, in order to produce a 10 Hz standard signal (1/10 second signal) from the divided signal frequencies as obtained from frequency divider 102 and the crystal controlled oscillator oscillating at a frequency of $2^{15}$ (i.e., oscillating at a frequency of $2^P$ according to the present embodiment), it is necessary to employ a frequency source capable of providing a signal frequency the lower limit of which has a value closest to and greater than 10 Hz, namely a frequency greater than $2^4=16$ Hz.

Reference numeral 103 denotes a frequency reduction circuit which is supplied with frequencies f1 to f4 and adapted to reduce frequency f1 by a ratio of $\frac{5}{8}$. The circuit removes 24 pulses from frequency f1 which is comprised of 64 pulses for each one second period, and then produces a frequency signal which consists of 40 pulses over a period of one second. Reference numerals 104 and 105 designate frequency dividers which construct a frequency divider circuit 106 adapted to divide an input signal by $\frac{1}{4}$. This circuit accordingly produces an output signal G having a frequency of 10 Hz.

FIG. 13 is a diagram showing in detail an embodiment of circuit 103 illustrated in FIG. 12. FIG. 15 is a timing chart showing the signal waveforms associated with the main components of FIG. 13. Reference numerals 107 to 110 indicate inverters, and reference numeral 111 is a circuit for removing pulses P1 from the frequency signal f1. Circuit 111 is composed of flip-flops constructed by NAND gates 111*a* and 111*b*, and an AND gate 111*c*, and is adapted to provide an output signal A. Reference numeral 112 denotes an AND gate for removing pulses P4 from frequency signal f1 and which supplies an output signal B. Reference numeral 113 designates a NOR gate for removing pulses P7 from frequency signal f1 and which supplies an output signal C. Reference numeral 114 denotes a NOR gate which produces a signal D from frequency signal f1. Accordingly, OR gate 114 which is supplied with signals A through C and a frequency signal f1 from inverter 110 operates to remove pulses P1, P4 and P7 from frequency signal f1 except when signals A, B and C attain low logic levels when f1 is at a low logic level. Consequently, NOR gate 114 produces a 40-pulse signal D for every one second period, and this signal is divided by dividing circuit 106 so as to provide a signal G having a frequency of 10 Hz.

FIG. 14 shows another embodiment of circuit 103, and FIG. 16 illustrates a timing chart showing the signal waveforms associated with its principal components. Here, reference numerals 115 through 117 denote inverters, reference numeral 118 denotes a circuit constituted by OR gate 118*a* and AND gate 118*b* for the purpose of removing pulses P2, P4 and P6 from frequency signal f1 whereby AND gate 118*b* produces signal e shown in FIG. 16. Reference numeral 119 designates a NOR gate and is supplied with signal E and frequency signal f1 obtained from inverter 117 NOR gate 119 is adapted to remove pulses P2, P4 and P6 from frequency signal f1 whenever signal E attains a high logic level at such a time where f1 is at a low logic level. Consequently, NOR gate 119 produces a 40-pulse signal F for every one second period, and this signal is divided by dividing circuit 106 so as to provide a signal G having a frequency of 10 Hz.

It can be understood from FIGS. 12 through 16 that in this illustrated embodiment, $$16\times 2^n\times\tfrac{5}{8}\times\tfrac{1}{2}^n=10\ (\text{Hz}).$$

Accordingly, with n taken as equal to 2 in the present embodiment, circuit 103 reduces the frequency, i.e., the pulse number, by a ratio of $\frac{5}{8}$, taking as the frequency signal the signal f1 which has a frequency of 64 Hz ($16\times 2^2$) obtainable from the factor $2^P$. Thus, 24 pulses are removed, leaving signals D and F which consist of 40 suitably spaced pulses per one second period. Moreover, by using dividing circuit 106 to divide signals D or F by a ratio of $\frac{1}{2}^2$, a 10 Hz reference signal Ga is obtained.

It should be stated here that for the sake of convenience the timing charts shown in FIGS. 15 and 16 are abbreviated to illustrate only one-half a period since the first and second halves of one period are identical. Furthermore, $t_o$ through $t_5$, and $t_{oa}$ through $t_{5a}$ are instantaneous points in time. For the timing errors over the intervals $t_o$ to $t_5$ and $t_{oa}$ to $t_{5a}$, $t_o$ is taken as representing an error of 0. By so doing, $t_1$ shows as error of +0.00625, $t_2$ an error of −0.003125, $t_3$ an error of +0.003125, $t_4$ an error of −0.00625, and $t_5$ after 0.5 seconds of time shows as error of 0. Thus, after a long period of use the cumulative error is 0. Moreover, since the error at any instant in time is suppressed to within ±0.01, this has no practical detrimental effect.

In a similar manner the timing errors which arise in FIG. 16 can be expressed as follows, taking the error at $t_{oa}$ as 0: for $t_{1a}$, −0.009375 seconds; for $t_{2a}$, −0.003125 seconds; for $t_{3a}$, +0.003125 seconds; for $t_{4a}$, +0.009375 seconds; and 0 at $t_{5a}$. Again, there is no cumulative error after a long period, and instantaneous errors of ±0.01 are negligible.

It can thus be appreciated that the illustrated embodiment of FIG. 12 makes it possible by very simple means to produce a 0.1 second resolvable standard signal from a crystal controlled oscillator which oscillation at a frequency of $a^p$. This has a wide application in electronic timepieces and is particularly suited to adapting a stop-watch function for a wristwatch.

FIG. 17 shows a block diagram of another preferred embodiment of an electronic timepiece of the present invention. Reference numeral 201 denotes a crystal controlled oscillator with a frequency of 32768 Hz, and reference numerals 202 through 213 designate flip-flops which constitute a frequency divider by which the following output frequencies are produced:

divider 202 . . . 16384 Hz
divider 203 . . . 8192 Hz
divider 204 . . . 4096 Hz
divider 205 . . . 2048 Hz
divider 206 . . . 1024 Hz
divider 207 . . . 512 Hz
divider 208 . . . 256 Hz
divider 209 . . . 128 Hz
divider 210 . . . 64 Hz
divider 211 . . . 32 Hz
divider 212 . . . 16 Hz
divider 213 . . . 8 Hz Reference numerals 214 and 215 denote NAND gates, NAND gate 214 receiving signals from frequency dividers 207 and 208, and NAND gate 215 receiving signals from NAND gate 214 as well as flip-flops 209 through 213. An output signal obtained from NAND gate 215 and a signal supplied by flip-flop 206 are applied to AND gate 216 which produces a signal that appears at terminal 217.

Before proceeding with the operation of the above-mentioned circuit, it will be helpful for the sake of understanding to consider the following calculation:

$1024\times2^n\times125/128=1000\times2^n$, where n is an integer. Accordingly, if by way of example n=0, a 1024 Hz signal is multiplied by 125/128 so that a 1000; pulse/sec signal appears at terminal 217. Now, if the outputs of frequency dividers 207 through 213 are considered to be at L logic levels, then 64 input pulses are required to raise flip-flop 213 to an H level, 32 input pulses are required to raise flip-flop 212 to an H level, and similarly, 16 are required for flip-flop 211, 8 are required for flip-flop 210, 4 are required for flip-flop 209, 1 input pulse is required in order for NAND gate 214 to maintain an H logic level. If the numbers of input pulses required to simultaneously raise flip-flops 209 through 213 and NAND gate 214 to H logic levels are added, the sum is found to be 125. Thus NAND gate 215 produces an H level signal until 125 of 128 input pulses are counted; since the signal maintains an L level signal only during the remaining three pulses, the logical product of flip-flop divider 206 and NAND gate 215 give a signal of 1000 pulse/sec. In other words, for one second of time, a $$1024\times125/128=1000 \text{ pulse/sec}$$

signal is obtained. This signal is then divided by a frequency dividing circuit (not shown) which is capable of reducing the frequency by a factor of $\frac{1}{2}^n$. Although in the present embodiment no other frequency divider is in fact necessary since n=0, a frequency divider with a dividing ratio of $\frac{1}{2}$ may be employed for a case in which n=1. A signal reduced in frequency by a factor of $\frac{1}{2}^n$ is then applied to a plurality of series connected decimal counters (not shown), and by means of decoders and drivers the content of the decimal counters can be displayed by a display device consisting of liquid crystals or light emitting diodes.

According to the invention, flip-flop 213 provides an output signal having a frequency of 8 Hz. The error for each $\frac{1}{8}$ second is thus (128-125)/128 or $\frac{1}{8}\times3/128=0.3\%$ per second. If a 1/1000 second signal is not necessary, the error can be further reduced by 1/10 so as to obtain an error of 0.03% per second when counting in units of 1/100 second. Since in order to obtain a 1 second signal the information at terminal 217 is fed to 3 stages of divide-by 10(decimal) counters, the error for the 1 second signal is substantially reduced to 0 so that there is no cumulative error if measured over a long period of time. Accordingly, since the error is within an allowable tolerance of 0.03% for one second or less, it can be understood that this invention has sufficient practical value.

It can thus be appreciated that the present invention makes it possible to produce a 1/100 second resolvable signal from a crystal controlled oscillator which oscillates at a frequency of $2^p$. This has a wide application in electronic timepiece and is particularly suited to adapting a stop-watch function for a wristwatch.

It will now be appreciated from the foregoing description that in accordance with the present invention since a plurality of segments of a band of segments are arranged to be displayed as a group, it is possible to read time in units of 1/10 second even in a case in which the response speed of a liquid crystal display device is slow.

While the present invention has been shown and described with reference to particular embodiments by way of example, it should be noted that any other modifications or changes may be made without departing from the scope of the present invention.

What is claimed is:

1. A digital electronic timepiece comprising:

circuit means for producing a signal having a period of one-tenth second and a signal having a period of one seconds;

externally actuated switch means for producing switching signals;

control circuit means responsive to said switching signals for selectively producing a start signal, a stop signal, a reset signal and a chronograph display enable signal, said chronograph disply enable signal going to a first logic level potential upon an initiation of said start signal and going to a second logic level potential upon a subsequent initiation of said stop signal;

timekeeping circuit means responsive to said one second signal for computing current time information and for producing timekeeping signals indicative thereof;

chronograph counter circuit means responsive to said one-tenth second signal and said start signal for computing elapsed time information in one-tenth second increments and for producing chronograph information signals indicative thereof, responsive to said stop signal for terminating said computation of elapsed time, and responsive to said reset signal for being reset to a count of zero;

liquid crystal display means having a first display section for displaying said timekeeping information in digital form, a second display section for displaying a portion of said chronograph information exceeding a value of one second, in digital form, and a third display section for displaying a portion of said chronograph information of value less than one second, said third display section comprising a set of display segments arranged successively adjacent to one another, each of said display segments capable of being selectively set to a first visual state and a second visual state, with a visible contrast existing between said first and second visual states; and decoder circuit means provided between said liquid crystal display means and said timekeeping circuit and chronograph counter circuit means;

said decoder circuit means being responsive to the first logic level state of said chronograph display enable signal for applying signals to said liquid crystal display means whereby a plurality of said set of display segments are simultaneously set to said first visual state and the remainder of said set of display segments to said second visual state, and whereby said plurality of segments in said first visual state is successively transferred along said set of display segments in a predetermined direction in steps of 1/10 second, said transfer of said plurality of display segments in said first visual state being performed in a sequentially repetitive manner, said decoder circuit means being further responsive to the second logic level state of said chronograph display enable signal for applying a signal to said electro-optical display means whereby a single one of said set of display segments is set in said first visual state and the remainder thereof to said second visual state, said single display segment having a position indicative of a number of tenths of second of said chronograph information at the instant of initiation of said stop signal.

2. A digital electronic timepiece according to claim 1, in which said control circuit means further selectively produces a control signal in response to said switching signals from said externally actuated switch means, and further comprising switching circuit means coupled to receive said timekeeping signals and said chronograph information signals, and responsive to said control signal for selectively transferring said timekeeping signals and said chronograph information signals to said decoder circuit means a single display section of said liquid crystal display means serving in common to selectively display said timekeeping information and said chronograph information in digital form, in accordance with the condition of said control signal.

3. A digital electronic timepiece according to claim 2, in which said current time information includes weekdays information, and in which a signal produced by said decoder circuit means when said timekeeping information is transferred thereto by said switching circuit means causes one of said set of display segments to enter said first visual state, to thereby indicate a weekday.

4. A digital electronic timepiece according to claim 2, in which said current time information includes one-tenth seconds of current time information, and in which signals produced by said decoder circuit means when said timekeeping information is transferred by said switching circuit means cause each of said set of display elements to sequentially enter said first visual state, to thereby indicate tenths-of-second information of current time.

5. A digital electronic timepiece according to claim 2, in which said control circuit means further selectively produces a current time display enable signal in response to said switching signals from said externally actuated switch means, and in which said decoder circuit means comprises:

a first set of logic gates coupled to receive output signals from said switching circuit means and responsive to said current time display enable signal for producing an output signal to be applied to one of said set of display segments, to thereby indicate a portion of current time information;

a second set of logic gates coupled to receive output signals from said switching circuit means and responsive to said chronograph display enable signal being at said first logic level potential for producing output signals to be applied to said electro-optical display means whereby a plurality of said set of display segments are simultaneously placed in said first visual state and the remainder thereof in said second visual state, said output signals causing said plurality of segments in said first visual state to be transferred along said set of display segments in steps of one-tenth seconds in a sequentially repetitive manner; and a third set of logic gates coupled to receive output signals from said switching circuit means and responsive to the second logic level state of said chronograph display enable signal for producing an output signal to be applied to said electro-optical display means for thereby causing one of said set of display segments to be placed in said first visual state and the remainder thereof in said second visual state, to indicate one-tenths of second information in said chronograph information.

6. A digital electronic timepiece according to claim 3, in which said current time information further includes AM/PM information, and in which a signal produced by said decoder circuit means when said timekeeping information is transferred thereto by said switching means causes one of said set of display segments to enter said first visual state, to thereby indicate AM/PM information.

7. An electronic timepiece comprising, in combination:

circuit means for producing a signal having a period of one-tenth second and a signal having a period of one second:

externally actuated switch means for producing switching signals;

control circuit means responsive to said switching signals for selectively producing a control signal, a start signal, a stop signal, a reset signal, a current time display enable signal and a chronograph display enable signal, in response to said switching signals, said chronograph display enable signal going to a first logic level upon an initiation of said start signal and to a second logic level upon a subsequent initiation of said stop signal;

timekeeping circuit means responsive to said one-second signal for computing current time information including hours, minutes, weekdays and AM/PM information and for producing timekeeping signals indicative thereof;

chronograph counter circuit means responsive to said one-tenth second signal and said start signal for computing elapsed time information in one-tenth second increments and for producing chronograph information signals indicative thereof, responsive to said stop signal for terminating said computation of elapsed time, and responsive to said reset signal for being reset to a count of zero;

a switching circuit coupled to receive said timekeeping signals and said chronograph information signals and responsive to said control signal for selectively transferring said timekeeping signals and said chronograph information signals to output terminals thereof;

a decoder circuit coupled to receive said timekeeping signals and said chronograph information signals selectively transferred from said switching circuit; and liquid crystal display means having a first display section for selectively displaying said hours and minutes information of current time and a portion of said elapsed time information of value which is an integral multiple of one second, in digital from, in accordance with a state of said control signal, and a second display section for selectively displaying a portion of said chronograph information of value less than one second and said weekdays and AM/PM information in accordance with a condition of said control signal, said second display section comprising a set of display segments arranged successively adjacent to one another, of said display segments being capable of being selectively set to a first visual state and a second visual state, with a visible contrast existing between said first and second visual states;

said decoder circuit being responsive to the first logic level of said chronograph display enable signal when said chronograph information is being applied thereto from said switching circuit for applying signals to said liquid crystal display means whereby a plurality of said set of display segments are simultaneously set to sid first visual state and the remainder of said set of display segments to said second visual state, and whereby said plurality of display segments in said first visual state is successively transferred along said set of display segments in a predetermined direction in steps of one-tenth second, said transfer being performed in a sequentially repetitive manner, decoder circuit being further responsive to the second logic level state of said chronograph display enable signal for applying a signal to said liquid crystal display means whereby a single one of said set of display segments is set in said first visual state, said single display segment having a position indicative of a number of tenths of second of said chronograph information at the instant of initiation of said stop signal.

* * * * *